United States Patent [19]

Hupp et al.

[11] 3,954,042

[45] May 4, 1976

[54] FIREARM CONSTRUCTION, PARTICULARLY A COMPACT HAND FIREARM

[75] Inventors: Gerhard Hupp, Oberndorf (Neckar); Helmut Mader, Schramberg, both of Germany

[73] Assignee: Industrie-Werke Karlsruhe Augsburg Aktiengesellschaft, Karlsruhe, Germany

[22] Filed: Mar. 8, 1974

[21] Appl. No.: 449,458

[30] Foreign Application Priority Data

Mar. 19, 1973 Germany ..... 2313591

[52] U.S. Cl. ..... 89/155; 89/26

[51] Int. Cl.[2] ..... F41D 7/04

[58] Field of Search ..... 89/26, 155; 42/1 S

[56] References Cited

UNITED STATES PATENTS

| | | | |
|---|---|---|---|
| 245,792 | 8/1881 | Cory | 89/26 |
| 726,109 | 4/1903 | Stow | 89/155 |
| 794,852 | 7/1905 | Clarke | 89/155 |
| 2,976,770 | 3/1961 | Fletcher | 89/155 |
| 3,170,261 | 2/1965 | Ludovici | 89/155 |
| 3,620,124 | 11/1971 | Wiese | 89/26 |
| 3,742,636 | 7/1973 | Dealy et al. | 42/1 S |
| 3,817,148 | 6/1974 | Schirneke | 89/155 |

*Primary Examiner*—Stephen C. Bentley
*Attorney, Agent, or Firm*—McGlew and Tuttle

[57] ABSTRACT

A firearm, particularly a compact weapon for firing caseless ammunition, comprises a support having a handle and a firing trigger adjacent the handle connected to a firing mechanism in the butt preferably for firing caseless ammunition. A plurality of barrels are arranged in parallel relationship on the support and a magazine is rotatably mounted on the support between the support and the butt which is pivoted at the end of the support. The magazine includes a plurality of radially spaced circumferentially extending rows of cartridge receiving bores which are aligned with the respective barrels and adapted to be indexed into association with each barrel. The magazine includes means for sealing the bores during the firing of the cartridge and for permitting the passage of the pressure gases to a control bore having a control piston therein which is movable by the combustion gases to index the magazine during each firing.

15 Claims, 3 Drawing Figures

FIREARM CONSTRUCTION, PARTICULARLY A COMPACT HAND FIREARM

BACKGROUND OF THE INVENTION

1. Field of the Invention

This invention relates in general, to the construction of firearms and, in particular, to a new and useful firearm having a plurality of barrels and which includes a magazine which is rotatably mounted at the rear of the barrels in a position between the stock or support and the rifle butt and which includes a control piston operated magazine for caseless ammunition which is indexed by a control piston which is moved by the gases generated during the firing of each cartridge.

2. Description of the Prior Art

The object, design and method of operation of modern hand firearms are determined by their tactical use. They should, as a rule, be lightweight, simple to handle, have a large ammunition supply, a high initial velocity (V*o*) of the projectiles, high accuracy and firing rate as well as be trouble-free, even under extreme environmental conditions.

The enumeration of these properties shows that they partly exclude each other. Thus, for example, a lightweight weapon can hardly hold a large supply for ammunition both in amount and in weight. A high firing rate and great accuracy cannot be combined in the conventional design of hand firearms. Finally, a desirable high initial velocity (V*o*) of the projectiles is diametrically opposed to a compact and thus handy firearm, since the length of the barrel, in addition to the layout and dimension of the ammunition, determines the initial velocity of the projectile.

SUMMARY OF THE INVENTION

The object of the present invention is to provide a compact firearm which combines in an optimum manner lightweight with a great ammunition supply, simple handling and trouble-free operation, relative high initial velocity (V*o*) of the projectiles and relatively great length of the barrel, as well as an extremely high firing rate.

This problem is solved according to the invention, substantially by several, for example, three barrels extending parallel to each other. A preferably axially symmetrical and gas-tight magazine, forming an integral part of the weapon, is arranged between the ends of the barrels and a butt in the longitudinal axis of the weapon. The magazine has a plurality of cartridge chambers, or combustion chambers and sealing means to seal each chamber during firing. The magazine is indexed depending on the number of rounds determined by the number of barrels, by means of a ratchet mechanism actuated by a control piston admitted with gas pressure during the firing.

In an advantageous embodiment of the invention, the magazine housing is provided on its circumference with a substantially diagonal separating joint by means of which it can be divided into two equal parts.

In a further development of this feature of the invention, the part of the magazine housing rigidly connected with the butt is pivotally mounted on the part of the magazine housing adjoining the barrels, and the two magazine housing parts are provided with manually operated means for joint locking and unlocking.

One feature of the invention provides that a substantially axially symmetrical rotational body is provided in the center of the magazine parallel to the longitudinal axis of the weapon, which serves to receive and support the ratchet indexing mechanism. The body carries two spring-loaded bolts, displaced by 180°, relative to each other which act on a pawl which is rotatably mounted on the body. The body is arranged in a bearing secured in the weapon housing. The housing is provided with slots displaced by 180° relative to each other for the passage of the pawls rotatably mounted in the body. The spring-loaded pawls engage recesses which are distributed over the circumference of the magazine concentrically to the bearing secured in the weapon housing.

Each cartridge chamber arranged in the magazine or each of the combustion chambers is sealed from the weapon housing in the direction of the barrel muzzles by means of sealing rings and preferably each cartridge arranged in the magazine or each combustion from the weapon housing in the direction of the butt is sealed by means of journals, plugs, etc., which are secured on a substantially annular ring plate secured in the weapon housing and common to all cartridge chambers or combustion chambers. The journals, plugs, etc., are provided with sealing rings. The journals, plugs, etc., are, in addition, provided with a centric bore extending coaxially to the longitudinal axis of the weapon for the passage of the ignition means secured in the butt.

In an expedient embodiment the barrel support has a bore which absorbs the gas pressure produced during the firing in one tube and which is in communication through a transverse bore arranged in the housing or support with a control bore having a control piston therein supported by a spring.

For transforming the linear movement of the control piston into a circular movement, which is necessary to step up the magazine, it is suggested according to the invention, that a journal, etc., in the form of a sliding block, which is an integral part of the body of rotation receiving the ratchet protrudes into the space formed between the spring support and the control piston. This feature of the invention is finally supplemented and completed by the fact that the space into which the journal, etc., in the form of a sliding block protrudes, is a slot, arranged in the body of rotation eccentrically to its axis of rotation.

It is obvious and at the same time convincing that, the compact firearm according to the invention results in a number of marked advantages.

The weapon is relatively simple in design and manufacture, since it contains relatively few parts, compared to similar weapons. An essential advantage is primarily the design of the large magazine and its inclusion as an integral part of the weapon. Due to the large amount of relatively lightweight ammunition in the magazine, compared to conventional ammunition, the user has not only always a ready-to-fire weapon available, but he can, independent of logistics, carry a much larger supply of ammunition which is in a ratio of about 2:1, compared to conventional, that is, case ammunition.

The advantages resulting from the suggested weapon are by no means exhausted by the foregoing features. By the arrangement of three barrels, its life is practically increased three-fold, so that logistic problems are reduced in inverse proportion by the same amount.

It is obvious that the three-barrel weapon has an extremely high firing rate. The latter is at least theoretically infinite, but practically it is limited to about 60,000 to 100,000 rounds per minute in dependence on the ignition lag time of caseless ammunition. Such a limitation is also desirable insofar as it must be ensured that the shock waves produced at each shot do not influence each other negatively. This limitation has in addition, a positive effect on the achievement of good plotted hits.

Due to the fact that the barrels of the otherwise relatively compact weapon are rather long, an initial projectile velocity is achieved, in combination with the ammunition related internal ballistics, which is still far above that of comparable hand firearms.

Though logistic problems are relatively minor, as mentioned above, due to the large magazine provided according to the invention, and the carrying of a greater ammunition supply by the user, the firing rate permits a rather high ammunition consumption. By a corresponding technical constructional design of the stepping mechanism of the magazine it is ensured, however, that the ammunition consumption remains within tolerable limits: The soldier can only fire three shots at a time in continuous firing, since the stepping mechanism of the magazine is only then actuated to make the next three rounds (one per barrel) ready for firing.

Accordingly, it is an object of the invention to provide an improved firearm particularly for compact weapons and which is advantageously capable of firing caseless ammunition and which includes a plurality of barrels preferably at least three and which includes a magazine having a plurality of circumferentially extending rows of bores which is journaled for rotation between the ends of the barrels and a butt portion of the gun and which is indexed during the firing of each cartridge by the movement of a control piston under the influence of the pressure gases generated during firing.

A further object of the invention is to provide a relatively small compact weapon capable of firing a plurality of rounds of ammunition in rapid succession and which uses a plurality of barrels and a magazine which is rotated during firing and which includes sealing means for sealing the cartridge chamber and an ignition means for igniting the cartridges which are moved into association with the barrels.

A further object of the invention is to provide a weapon which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENT

Figure 1:
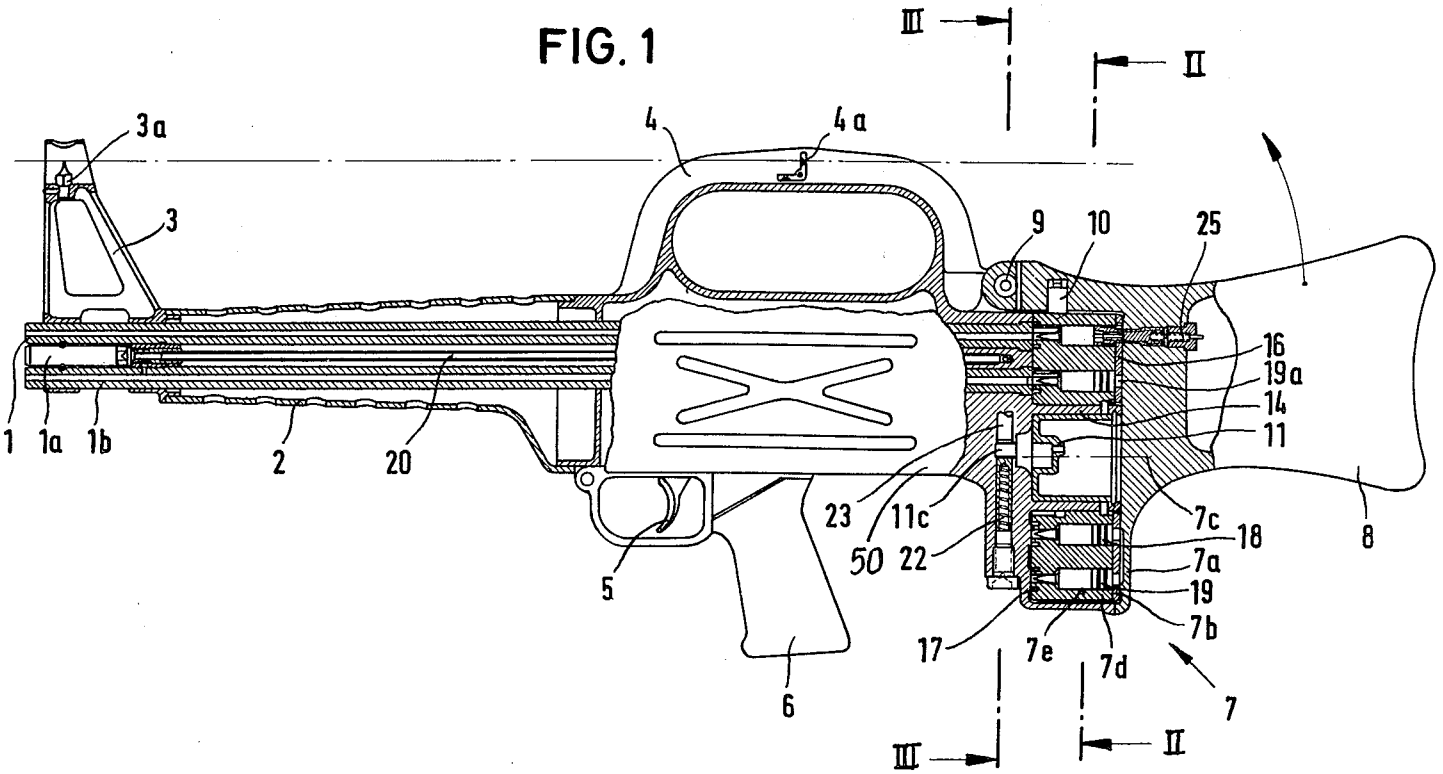
FIG. 1 is a partial side elevational and longitudinal sectional view of a gun constructed in accordance with the invention.

Referring to the drawings in particular the invention embodied therein comprises a compact firearm which has a plurality of gun barrels preferably three barrels designated 1, 1*a* and 1*b*. The barrels are mounted in a housing or a support 50 which includes a forward tubular hand guard portion 2 on the front end of which is mounted a front sight holder 3 having a front sight 3*a*. The housing 50 also includes a handle portion 4 which is diametrically opposite to the gun handgrip or handle 6 and which mounts a sight notch or rear sight 4*a*. A trigger mechanism 5, which is located directly in front of the handle 6, is connected to actuate a firing mechanism 25 which is mounted in a butt portion 8. The butt portion 8 is pivotally mounted on a horizontal pivot 9 to the housing 50 and a magazine generally designated 7 is rotatably mounted on the housing 50 between the housing and the butt portion 8.

In accordance with the invention, the magazine housing 7*a* is provided on its circumference with a substantially diagonal separating joint 7*b*, as shown in FIG. 1, by means of which it can be divided into two substantially equal parts. One magazine housing part is rigidly connected with the butt 8 and is articulated at the pivot 9 with the butt 8. The two magazine housing parts are provided with manually operated means 10 for locking and unlocking the magazine. The means 10 advantageously comprise a detent which is displaceable by hand downwardly into a recess on the periphery of the magazine 7.

The central portion of the magazine body 7*d* is provided with a rotational body or cylinder 11 which is mounted for rotation about a central axis 7*c* on the housing 50. The body 11 is provided with two diametrically opposite cavities which contain spring-loaded bolts 12 which are displaced by 180° relative to each other and which act on respective pawls 13 which are pivotally mounted in the body 11. The body 11 includes a journal portion 11*c* which is rotatably supported in the housing 50. The body 11 is arranged within a sleeve 14 which is provided with slots 11*a* diametrically opposite the location for the passage of the pawls 13. The spring-loaded pawls 13 engage recesses 15 around the inner circumference of a bore of the magazine body 7*d* which are arranged concentrically to the bearing sleeve 14.

Each of the magazine chambers which are arranged on the magazine body 7*d* on each of the combustion chambers 7*e*, can be sealed from the weapon housing in the direction of the muzzles by means of known sealing rings 16. At the rear end of each of the combustion chambers 7*e*, the cartridge chambers are sealed from the weapon housing by means of journals or plugs 18. These journals or plugs are secured on a substantially annular plate 19 which is common to all of the cartridge chambers or combustion chambers. The journals or plugs 18 are also provided with a concentric bore 19*a* which extends coaxially to the longitudinal axis of the weapon and which carries ignition means 25 for igniting each cartridge which is to be fired.

Figure 3:
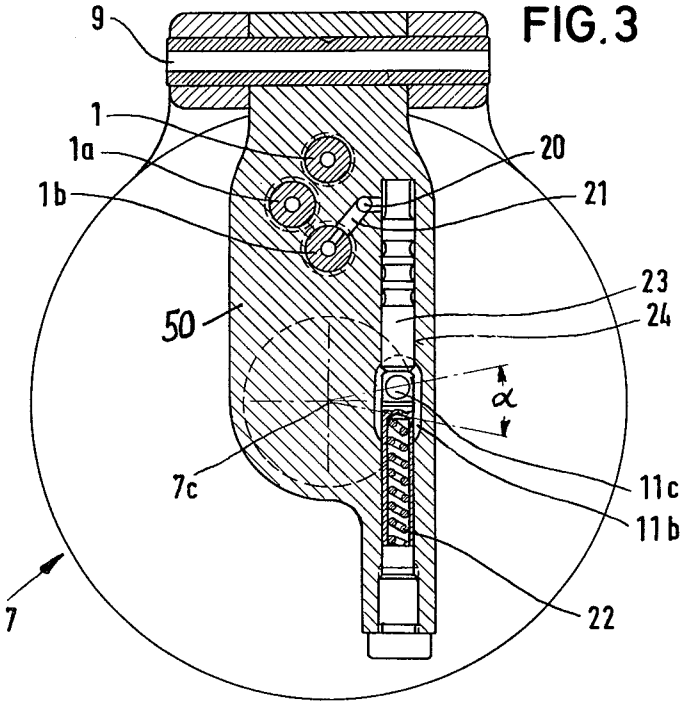
FIG. 3 is a section taken along the line III—III of FIG. 1.

The housing 50 carries a bore 20 which is coaxial to the barrels 1, 1*a*, and 1*b* which is designed to absorb the gas pressure generated in the barrels 1 during the firing and which is in communication through a transverse bore 21 as shown in FIG. 3 to a control bore 24. A control piston 23 is slidable in the control bore 24 and is biased by a spring 22 toward engagement with a journal 11*c* of the magazine rotational body 11. The journal 11*c* comprises a sliding block which is part of the body of rotation 11 carrying the ratchet 12 and pawl 13. The journal protrudes into the slot 11*b* of the body of rotation 11 at a location eccentrically to the axis of rotation 7*c*. Movement of the piston 22 during each firing will cause an indexing movement of the magazine due to the movement of the piston against the journal 11*c*.

In order to load the weapon the magazine housing part connected with the butt 8 is unlocked from the magazine housing part facing the barrels 1, 1*a*, 1*b* and it is turned about the axis of rotation of the horizontal pivot 9 in the direction of the arrow shown in FIG. 1. During the rotation the cartridge chambers or the combustion chambers 7*e* are exposed by the journals 18 which are secured on the annular plate 19 so that the caseless ammunition 16 can be introduced into the cartridge chambers or combustion chambers 7*e*. After magazine housing part which is rigidly connected with the butt 8 and has been opened for loading, is closed, the weapon is ready to fire.

When the trigger mechanism 5 is actuated, three rounds are detached in immediate succession in continuous fire. The projectiles leave each barrel 1, 1*a* and 1*b*. The weapon can also be set, however, to operate for independent fire in which one barrel at a time is fired.

Figure 2:
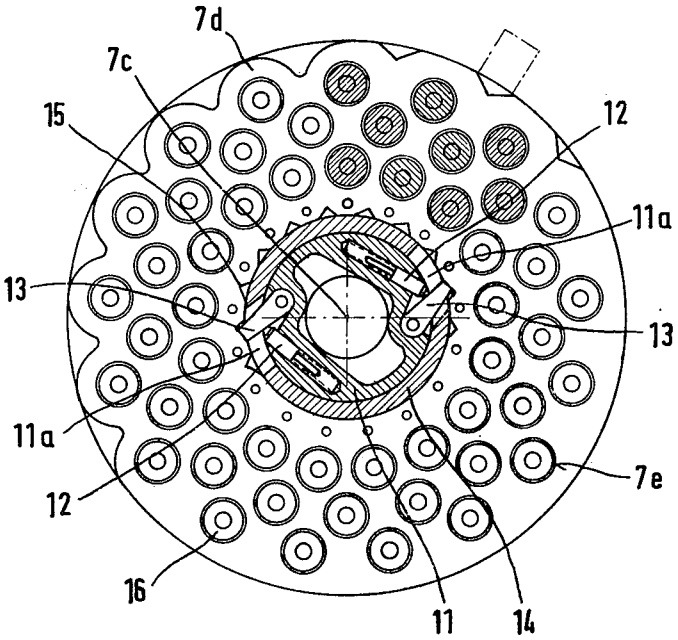
FIG. 2 is a section taken along the line II—II of FIG. 1.

The gas pressure built up in the tube 1*b* is conducted to the control bore 20 from the transverse bore 21 so that the piston 23 is moved against the pressure of the spring 22. During the downward stroke of the piston 23, a relatively slight angular movement through the angle alpha, indicated in FIG. 3, is imparted to the journal 11*c*. Since the journal 11*c* is part of the axially symmetrical body of rotation 11, its angular movement alpha is transmitted to the axially symmetrical body 11, which performs a rotary movement by the same angular amount along the magazine body 7*d* which is indexed by the pawls 13 by one division of the notches 15. During this angular movement the next three cartridges 16 which are arranged in the magazine body 7*d*, arrive in alignment with the associated barrels 1, 1*a* and 1*b*. When the trigger mechanism is actuated the firing process is repeated in the above described manner. In order to facilitate the understanding of the process in the weapon before the firing, some of the cartridges belonging to a triple group are shown in FIG. 2 with the cross hatching extending in different directions in respect to adjacent groups.

The ignition of the caseless ammunition can be effected in various ways depending on a given requirement. For example, it may be effected by means of a known firing pin assembly or electrically by means of piezoelectric generators, dry cell batteries, etc.

While a specific embodiment of the invention has been shown and described in detail to illustrate the application of the principles of the invention, it will be understood that the invention may be embodied otherwise without departing from such principles.

What is claimed is:

1. A firearm for firing caseless ammunition, comprising a support having a handle and a firing trigger adjacent said handle and a rear portion defining a rearwardly opening portion of a magazine chamber, a plurality of barrels arranged in parallel relationship on said support, a butt secured to said support and having a front portion defining a forwardly opening portion of said magazine chamber, said forwardly opening portion and said rearwardly opening portion of said magazine chamber together defining a substantially cylindrical magazine chamber, a rotatable cylindrical magazine rotatably mounted in said magazine chamber between said butt and said support and having a plurality of radially spaced circumferentially extending rows of cartridge receiving bores adapted to be indexed into association with each barrel, means associated with said magazine for sealing the bore during the firing of the cartridges, a control bore defined in said support adjacent said barrels having a connection with said barrels for the passage of pressure gases therethrough to said control bore during the firing of said cartridges, and a control piston in said control bore movable transversely to said barrels and connected to said magazine and movable by the gases during firing to rotate said magazine to index respective bores into alignment with said barrels.

2. A firearm according to claim 1, wherein said magazine chamber rearwardly opening and forwardly opening portions are equal and including a diagonal separating joint formed between said rearwardly opening portion and said forwardly opening portion of said magazine chamber.

3. A firearm, according to claim 1, wherein said magazine portions include manually operated means for locking and unlocking said portions together.

4. A firearm, according to claim 1, wherein said sealing means comprises an annular plate secured on said butt which is common to all of said cartridge chambers.

5. A firearm, according to claim 4, wherein said sealing means comprises a journal having sealing rings.

6. A firearm, according to claim 1, wherein said sealing means comprises a plate carried by said butt and having openings therethrough, and ignition means secured to said butt including a member which passes through the openings of said sealing plate to fire the cartridge.

7. A firearm, according to claim 1, including a bore parallel to the barrels of said gun, connected to at least one of said barrels and absorbing the gas pressure generated therein during firing, said bore being in communication with said control bore.

8. A firearm, according to claim 1, wherein said rotational magazine includes a journal portion eccentric to the rotational center of said body which protrudes into said control bore, said control piston acting against journal.

9. A firearm, according to claim 1, wherein said butt is pivotally mounted to said housing for rotation about a transverse axis, said housing having a lifting handle portion at its top overlying said trigger handle portion, a front sight mounted on the front of said housing and a rear sight mounted on the top of said lifting handle.

10. A firearm, according to claim 1, wherein said magazine includes three radially spaced circumferentially extending rows of cartridge chambers, said plurality of barrels comprising three separate barrels at least one of which is offset from the other two and all of which are arranged with the axes parallel, cartridge ignition means carried on said butt alignable with each magazine which is presented in front of an associated barrel.

11. A firearm, comprising a support having a handle and a firing trigger adjacent the handle, a plurality of barrels arranged in parallel relationship on said support, a butt secured to said support, a rotatable cylindrical magazine rotatably mounted between said butt and said support and having a plurality of radially spaced circumferentially extending rows of cartridge receiving bores adapted to be indexed into association with each barrel, means associated with said magazine for sealing the bores during the firing of the cartridges, a control bore defined in said support adjacent said barrels having a connection with said barrels for the passage of pressure gases therethrough to said control bore during the firing of said cartridges, and a control piston in said control bore connected to said magazine and movable by the gases during firing to rotate said magazine to index respective bores into alignment with said barrels, said magazine having a bore therethrough, a cylindrical body located in the bore of said magazine and having a spring-biased pawl therein projecting outwardly from said body to engage said magazine, said magazine having a plurality of recesses spaced around the interior circumferences of the bore thereof, said control piston being connected to rotate said body to index said pawls in respect to the notches of said bore of said magazine.

12. A firearm, according to claim 11, including a spring-loaded bolt engaged against said pawls, said rotational body having two diametrically arranged sets of bolts and pawls.

13. A firearm, according to claim 12, including a sleeve arranged within the bore of said magazine having slots therethrough for the passage of said pawls, said pawls being pivoted on said rotational body.

14. A firearm, according to claim 13, wherein the bore of the magazine includes circumferentially spaced triangular notches arranged around its interior surface accommodating said pawls, said bearing sleeve having a notch at diametrically opposite locations accommodating said pawls.

15. A firearm, according to claim 14, wherein said magazine includes three radially spaced circumferentially extending rows of cartridge receiving bores, said plurality of barrels comprising three separate parallel barrels.

* * * * *